US008289122B2

(12) United States Patent
Matthiesen et al.

(10) Patent No.: US 8,289,122 B2
(45) Date of Patent: Oct. 16, 2012

(54) REFLOWABLE THERMAL FUSE

(75) Inventors: Martyn A. Matthiesen, Fremont, CA (US); Jianhua Chen, Sunnyvale, CA (US); Anthony Vranicar, Santa Clara, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 17 days.

(21) Appl. No.: 12/383,560

(22) Filed: Mar. 24, 2009

(65) Prior Publication Data

US 2010/0245027 A1 Sep. 30, 2010

(51) Int. Cl.
*H01H 85/04* (2006.01)
*H01H 85/02* (2006.01)

(52) U.S. Cl. ..... 337/167; 337/297

(58) Field of Classification Search ..... 337/167, 337/297

See application file for complete search history.

(56) References Cited

U.S. PATENT DOCUMENTS

| | | | | |
|---|---|---|---|---|
| 2,386,094 | A | | 10/1945 | Duerkob |
| 2,613,297 | A | | 10/1952 | Laing |
| 2,790,049 | A | | 4/1957 | McAlister |
| 3,155,800 | A | | 11/1964 | Denton |
| 3,198,914 | A | | 8/1965 | Baran et al. |
| 3,629,766 | A | | 12/1971 | Gould |
| 3,840,834 | A | * | 10/1974 | Obenhaus et al. ..... 337/79 |
| 4,034,326 | A | | 7/1977 | Hill et al. |
| 4,058,784 | A | | 11/1977 | Gaia |
| 4,167,724 | A | | 9/1979 | McCaughna |
| 4,314,224 | A | | 2/1982 | Plasko |
| 4,352,082 | A | | 9/1982 | Barry et al. |
| 4,357,590 | A | * | 11/1982 | Belhomme ..... 338/23 |
| 4,383,236 | A | | 5/1983 | Urani et al. |
| 4,445,079 | A | * | 4/1984 | DeFilippis et al. ..... 318/792 |
| 4,451,814 | A | | 5/1984 | Barry et al. |
| 4,511,876 | A | | 4/1985 | Urani |
| 4,514,718 | A | | 4/1985 | Birx |
| 4,533,897 | A | | 8/1985 | Olson et al. |
| 4,593,262 | A | | 6/1986 | Krueger |
| 4,620,175 | A | | 10/1986 | Karr |

(Continued)

FOREIGN PATENT DOCUMENTS

DE 10-2005-045778 A1 3/2007

(Continued)

OTHER PUBLICATIONS

International Search Report for International Application No. PCT/US2010/000874, mailed May 18, 2010.

(Continued)

*Primary Examiner* — Anatoly Vortman

(57) ABSTRACT

A reflowable thermal fuse includes a positive-temperature-coefficient (PTC) device that defines a first end and a second end, a conduction element that defines a first end and a second end in electrical communication with the second end of the PTC device, and a restraining element that defines a first end in electrical communication with the first end of the PTC device and a second end, in electrical communication with a second end of the conduction element. The restraining element is adapted to prevent the conduction element from coming out of electrical communication with the PTC device in an installation state of the thermal fuse. During a fault condition, heat applied to the thermal fuse diverts current flowing between the first end of the PTC device and the second end of the conduction element to the restraining element, causing the restraining element to release the conduction element and activate the fuse.

8 Claims, 5 Drawing Sheets

U.S. PATENT DOCUMENTS

| | | | | |
|---|---|---|---|---|
| 4,631,626 | A | 12/1986 | Bohan | |
| 4,685,025 | A * | 8/1987 | Carlomagno | 361/106 |
| 4,727,347 | A | 2/1988 | Cambio et al. | |
| 4,727,348 | A | 2/1988 | Okazaki | |
| 4,808,960 | A | 2/1989 | Nixon | |
| 4,808,965 | A | 2/1989 | Cenky | |
| 4,888,573 | A | 12/1989 | Dunn | |
| 4,906,962 | A | 3/1990 | Duimstra | |
| 4,992,770 | A | 2/1991 | Spaulding et al. | |
| 5,043,689 | A | 8/1991 | DiTroia et al. | |
| 5,153,555 | A * | 10/1992 | Enomoto et al. | 338/22 R |
| 5,726,623 | A * | 3/1998 | Camp | 338/22 R |
| 5,781,394 | A | 7/1998 | Lorenz et al. | |
| 5,831,507 | A | 11/1998 | Kasamatsu et al. | |
| 5,886,613 | A | 3/1999 | Magoon et al. | |
| 5,945,903 | A * | 8/1999 | Reddy et al. | 337/197 |
| 5,990,779 | A * | 11/1999 | Katsuki et al. | 338/232 |
| 6,236,550 | B1 * | 5/2001 | Mochida et al. | 361/106 |
| 6,256,183 | B1 | 7/2001 | Moesian | |
| 6,300,860 | B1 * | 10/2001 | Hofsass | 337/377 |
| 6,304,166 | B1 | 10/2001 | McLoughlin | |
| 6,362,721 | B1 * | 3/2002 | Chen et al. | 338/22 R |
| 6,396,381 | B1 * | 5/2002 | Takeda | 337/377 |
| 6,914,416 | B2 | 7/2005 | Thomas et al. | |
| 7,148,785 | B2 * | 12/2006 | Becker et al. | 338/22 R |
| 7,345,570 | B2 | 3/2008 | Kawanishi | |
| 7,385,474 | B2 | 6/2008 | Kawanishi | |
| 7,607,829 | B2 | 10/2009 | Sumida et al. | |
| 2002/0011918 | A1 * | 1/2002 | Miyazaki et al. | 338/22 R |
| 2002/0089408 | A1 * | 7/2002 | Walsh et al. | 338/22 R |
| 2002/0175801 | A1 * | 11/2002 | Katsuki et al. | 338/22 R |
| 2004/0114286 | A1 * | 6/2004 | Sullivan et al. | 361/25 |
| 2004/0218329 | A1 * | 11/2004 | Becker et al. | 361/106 |
| 2006/0170528 | A1 | 8/2006 | Fukushige et al. | |
| 2006/0197647 | A1 | 9/2006 | Whitney et al. | |
| 2006/0273876 | A1 | 12/2006 | Pachla et al. | |
| 2007/0020509 | A1 | 1/2007 | Kim | |
| 2008/0117015 | A1 | 5/2008 | Leach | |
| 2009/0102595 | A1 | 4/2009 | Pachla et al. | |
| 2010/0085141 | A1 | 4/2010 | Knab et al. | |

FOREIGN PATENT DOCUMENTS

| | | | |
|---|---|---|---|
| EP | 0562438 | A1 | 9/1993 |
| FR | 2863100 | A1 | 6/2005 |
| FR | 2914108 | A1 | 9/2008 |
| JP | 2006-059568 | A | 3/2006 |

OTHER PUBLICATIONS

International Search Report for International Application No. PCT/US2010/000863, mailed Jul. 20, 2010.

* cited by examiner

REFLOWABLE THERMAL FUSE

BACKGROUND

I. Field

The present invention relates generally to electronic protection circuitry. More, specifically, the present invention relates to a self-activating surface mount thermal fuse.

II. Background Details

Protection circuits are often times utilized in electronic circuits to isolate failed circuits from other circuits. For example, a protection circuit may be utilized to prevent a cascade failure of circuit modules in an electronic automotive engine controller. Protection circuits may also be utilized to guard against more serious problems, such as a fire caused by a power supply circuit failure.

One type of protection circuit is a thermal fuse. A thermal fuse functions similar to that of a typical glass fuse. That is, under normal operating conditions the fuse behaves like a short circuit and during a fault condition the fuse behaves like an open circuit. Thermal fuses transition between these two modes of operation when the temperature of the thermal fuse exceeds a specified temperature. To facilitate these modes, thermal fuses include a conduction element, such as a fusible wire, a set of metal contacts, or set of soldered metal contacts, that can switch from a conductive to a non-conductive state. A sensing element may also be incorporated. The physical state of the sensing element changes with respect to the temperature of the sensing element. For example, the sensing element may correspond to a low melting metal alloy or a discrete melting organic compound that melts at an activation temperature. When the sensing element changes state, the conduction element switches from the conductive to the non-conductive state by physically interrupting an electrical conduction path.

In operation, current flows through the fuse element. Once the sensing element reaches the specified temperature, it changes state and the conduction element switches from the conductive to the non-conductive state.

One disadvantage with existing thermal fuses is that during installation of the thermal fuse, care must be taken to prevent the thermal fuse from reaching the temperature at which the sensing element changes state. As a result, existing thermal fuses cannot be mounted to a circuit panel via reflow ovens, which operate at temperatures that will cause the sensing element to open prematurely.

SUMMARY

In one aspect, a reflowable thermal fuse includes a positive-temperature-coefficient (PTC) device with first and second ends, a conduction element with a first end in electrical communication with the second end of the PTC device, and a restraining element, with a first end in electrical communication with the first end of the PTC device and a second end in electrical communication with a second end of the conduction element. The restraining element is adapted to prevent the conduction element from coming out of electrical communication with the PTC device in an installation state of the thermal fuse. During a fault condition, heat applied to the thermal fuse causes current flowing between the first end of the PTC device and the second end of the conduction element to be diverted to the restraining element, causing the restraining element to release the conduction element and activate the fuse.

In another aspect, a method for placing a reflowable thermal fuse on a panel includes providing a reflowable thermal fuse as described above. The reflowable thermal fuse is then placed on a panel that includes pads for soldering the surface mountable fuse to the panel. The panel is then run through a reflow oven so as to solder the surface mountable fuse to the panel.

DETAILED DESCRIPTION

To overcome the problems described above, a reflowable thermal fuse is provided. Generally, the reflowable thermal fuse includes a conduction element through which a load current flows, a positive-temperature-coefficient (PTC) device, and a restraining element. The restraining element is utilized to keep the conduction element in a closed state during a reflow process.

Under normal operating conditions, current that flows into the reflowable thermal fuse flows primarily through the PTC device and the conduction element. Some current also flows through the restraining element. During a high temperature and/or high current fault condition, the resistance of the PTC device increases. This in turn causes current flowing through the PTC device to be diverted to the restraining element until the restraining element mechanically opens. After the restraining element opens, the conduction element is allowed to enter an open state. In some embodiments, a high ambient temperature around the reflowable thermal fuse causes the sensor to lose resilience and/or melt. This in turn enables the conduction element to enter the open state. In other embodiments, current flowing into the reflowable thermal fuse and through the PTC device causes the PTC device to generate enough heat to cause the sensor to lose resilience and/or melt and thereby release the conduction element.

The details of the reflowable thermal fuse are set out in more detail below. The accompanying drawings are included to provide a further understanding and are incorporated in and constitute a part of this specification.

Figure 1:
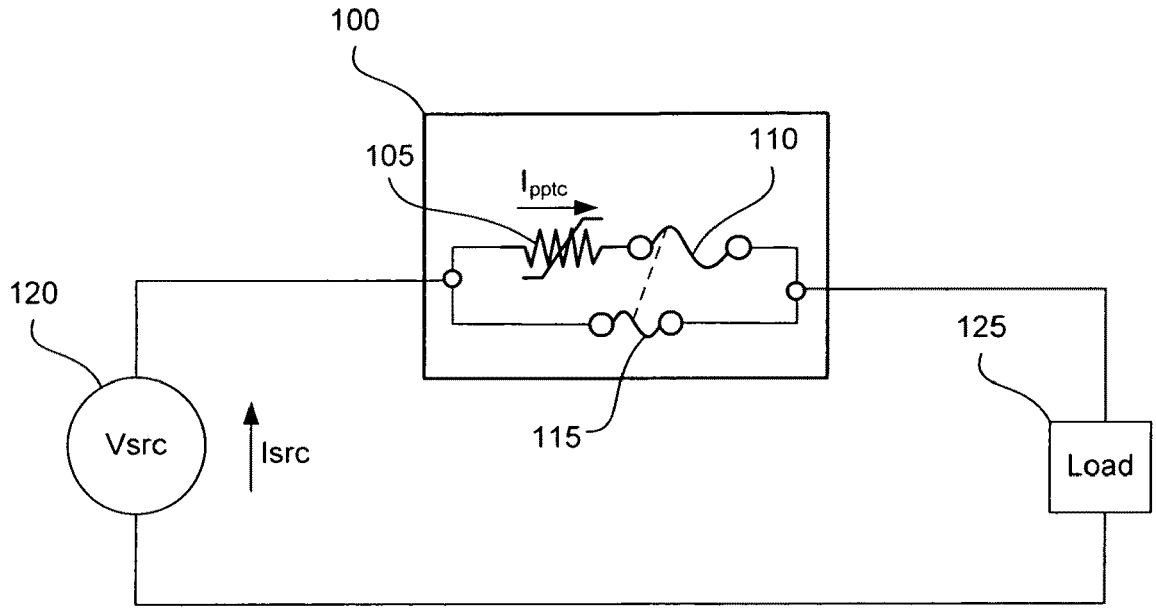
FIG. 1 is a schematic representation of a reflowable thermal fuse.

FIG. 1 is a schematic representation of a reflowable thermal fuse 100. The reflowable thermal fuse 100 includes a positive-temperature-coefficient (PTC) device 105, a conduction element 110, and a restraining element 15. The PTC device 105, conduction element 110, and restraining element 115 may be arranged within a housing, such as the housing 200 shown in FIG. 2.

Figure 2:
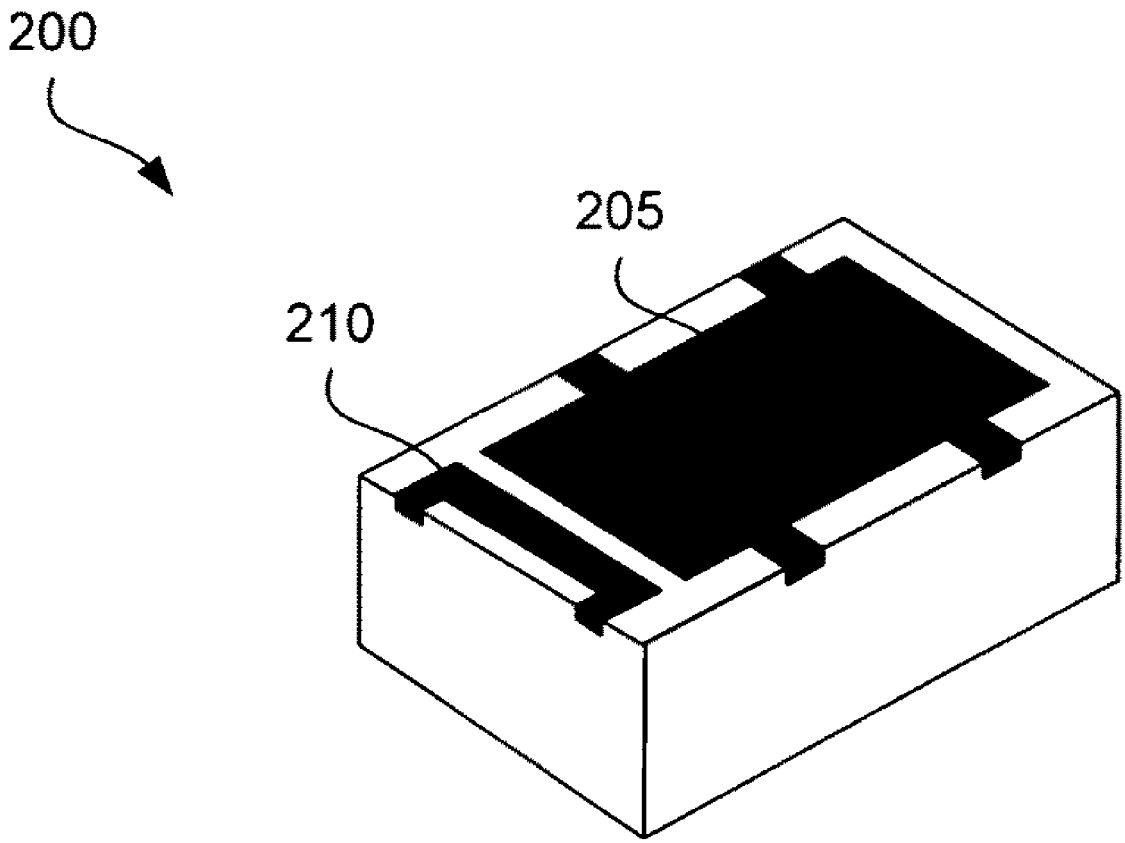
FIG. 2 is a bottom perspective view of an embodiment of a housing that may be utilized in connection with the reflowable thermal fuse.

As shown in FIG. 2, the housing 200 may include first and second mounting pads 210 and 205. The first and second mounting pads 210 and 205 may be utilized to bring circuitry disposed on a circuit panel into electrical communication with the PTC device 105, conduction element 110, and/or restraining element 115 disposed within the housing 200. In alternative embodiments, the PTC device 105, conduction element 110, and restraining element 115 may be arranged on a substrate, a circuit board, or a combination of the substrate, circuit board and/or housing.

Referring back to FIG. 1, the PTC device 105 corresponds to an electrical device with first and second ends. The PTC device 105 may correspond to a non-linear device with a resistance that changes in relation to the temperature of the PTC device 105. The relationship between the resistance and temperature of the PTC device 105 is shown in the graph of FIG. 3.

Figure 3:
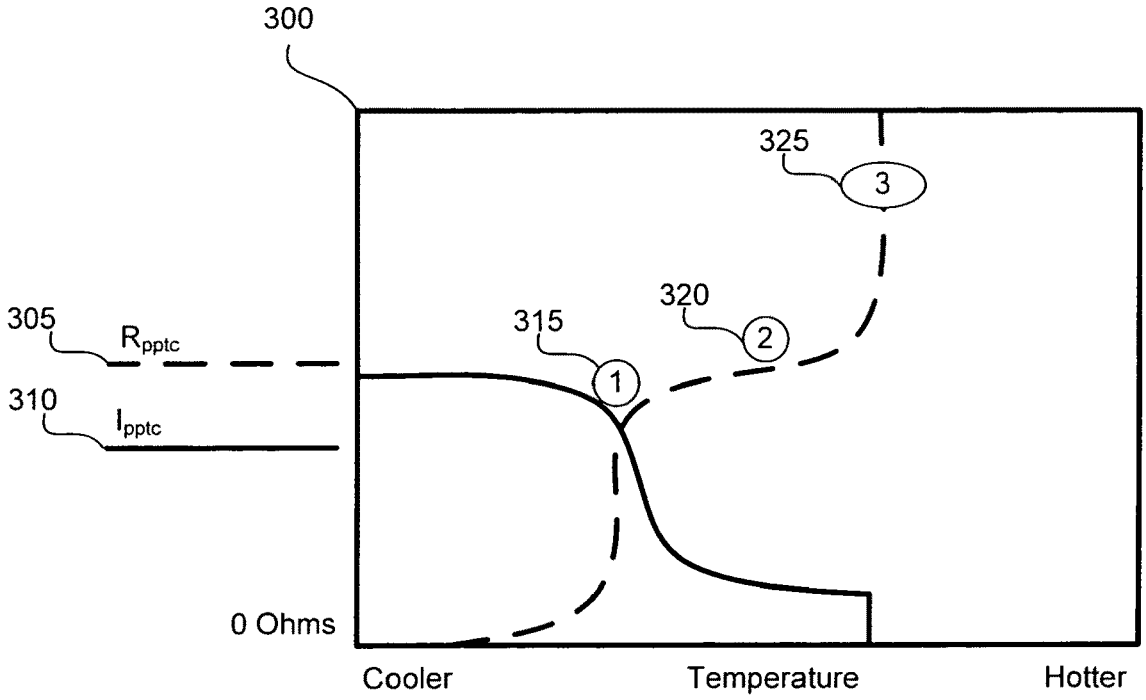
FIG. 3 is a graph that shows the relationship between the resistance and temperature of a PTC device utilized in connection with the reflowable thermal fuse.

Referring to FIG. 3, the horizontal axis of the graph represents the temperature PTC device 105. The vertical axis of the graph represents both the resistance 305 of the PTC device 105 and the current 310 that flows through the PTC device 105. As shown, at cooler temperatures, the resistance 305 of the PTC device 105 is relatively low. For example, the resistance 305 may be less than about 10 milliohms. As the temperature increase, the resistance 305 begins a sharp increase, as represented by region 1 315. As the temperature continues to increase, the resistance 305 enters a linear region 2 320. Finally, further increases in temperature place the PTC device 105 into a third region 325 where another sharp increase in resistance 305 occurs.

The current 310 through the PTC device 105 corresponds to the resistance 305 of the PTC device 105 over the voltage across the PTC device 105. The current 310 may be inversely proportional to the resistance 305 of the PTC device 105. As shown, as the resistance 305 increases, the current 310 decreases until almost no current flows through the PTC device 105.

Referring back to FIG. 1, the conduction element 110 includes first and second ends with one end in electrical communication with the PTC device 105. In some embodiments, the conduction element 110 includes a sensor that releasably secures the conduction element into electrical communication with the second end of the PTC device fuse. The sensor may correspond to any material that melts at the activation temperature of the thermal fuse. For example, the material may correspond to a solder that melts at about 200° C. Other materials that melt at higher or lower temperatures may also be used. The conduction element may also include a portion that is under a spring-like tension so that when the sensor melts, the conduction element mechanically opens, thus preventing current from flowing through the conduction element 110.

The restraining element 115 may include a first end in electrical communication with the first end of the PTC device 105 and a second end in electrical communication with a second end of the conduction element 110. The restraining element 115 is adapted to prevent the conduction element 110 from coming out of electrical communication with the PTC device 105 during an installation state of the reflowable thermal fuse 100. For example, one end of the restraining element 115 element may be physically attached to the conduction element 110 and the other end may be physically attached to the housing and/or substrate.

The restraining element 115 may correspond to any material capable of conducting electricity. For example, the restraining element 115 may be made of copper, stainless steel, or an alloy. The diameter of the restraining element 115 may be sized so as to enable blowing, or opening, the restraining element 115 during a fault condition. In one embodiment, the restraining element 115 opens when a current of about 1 Ampere flows through it. Applicants contemplate that the restraining element 115 may be increased or decrease in diameter, and/or another dimension, allowing for higher or lower currents.

Figure 4:
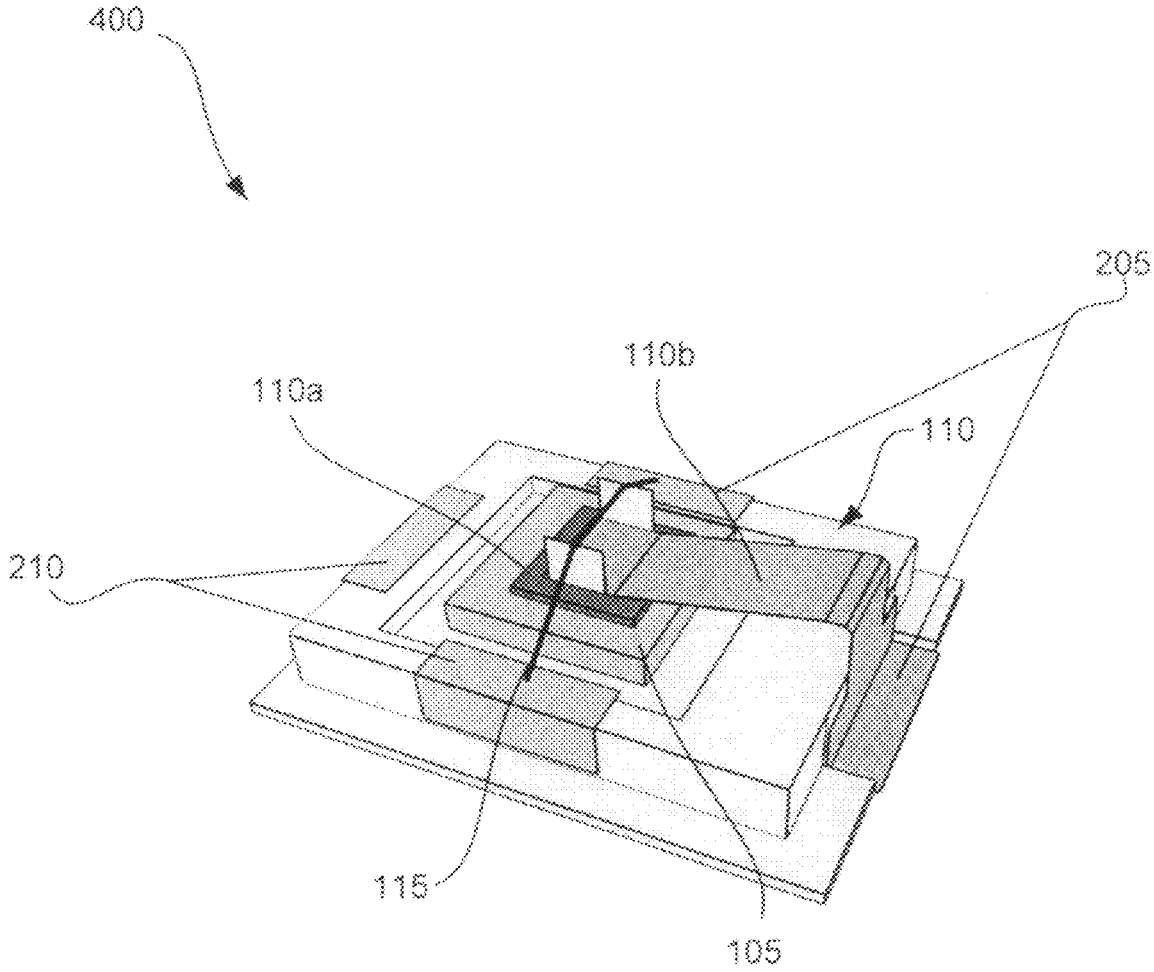
FIG. 4 is an exemplary mechanical representation of the reflowable thermal fuse of FIG. 1.

FIG. 4 is an exemplary mechanical representation 400 of the reflowable thermal fuse 100 of FIG. 1. In the exemplary embodiment, the conduction element 110 includes a sensor 110*a* and a spring portion 110*b*. A first end of the conduction element 110 may be in electrical communication with a first pad 205 and a second end of the conduction element 110 may be in electrical communication with a first end of the PTC device 105. The sensor 110*a* of the conduction element 110 may be made of a material that melts or otherwise loses its holding strength at an activation temperature, such as 200° C. The spring portion 110*b* may be under tension so that when the sensor 110*a* loses its holding strength, the conduction element separates from the PTC device 105.

The PTC device 105 may be disposed below the conduction element 110, as shown. A first end of the PTC device 105 may be in electrical communication with a second pad 210.

The restraining element 115 may be draped over a portion of the conduction element 110 and fixed to the first and second pads 205 and 210 as shown.

Figure 5:
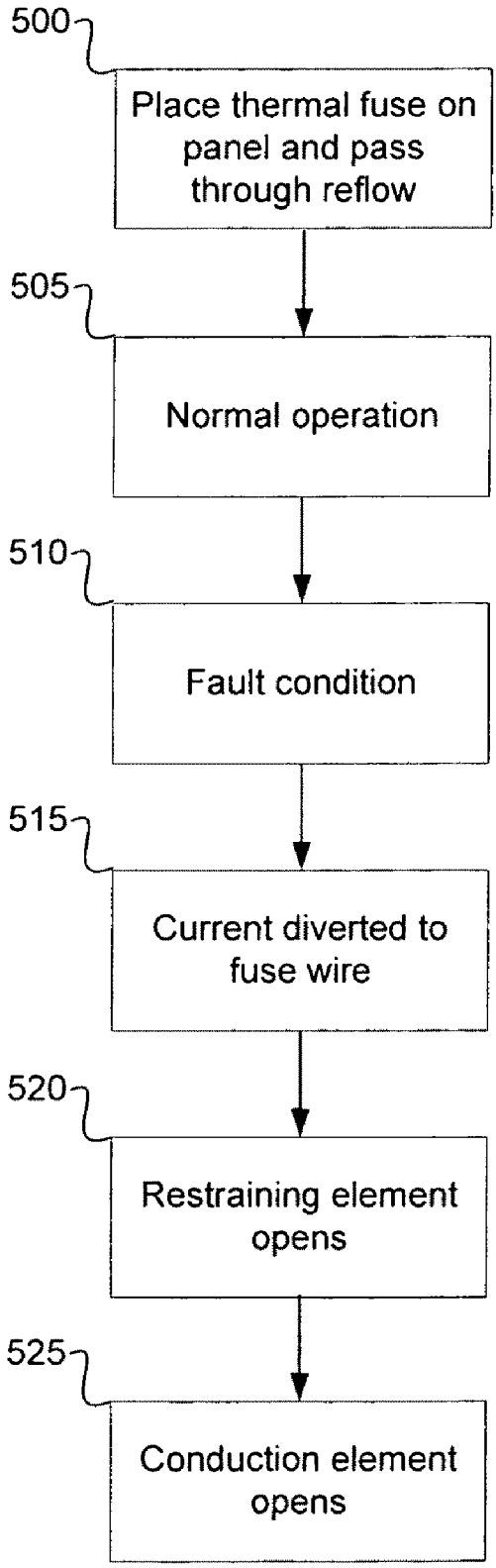
FIG. 5 is a flow diagram that describes operations of the reflowable thermal fuse of FIG. 1.

FIG. 5 is a flow diagram that describes operations of the reflowable thermal fuse 100 of FIG. 1. At block 300, the reflowable thermal fuse 100 is placed on a panel. Solder paste may have been previously applied to the pad locations on the panel associated with the reflowable thermal fuse 100 via a masking process. The panel, with the reflowable thermal fuse, is then placed into a reflow oven, which causes the solder on the pads to melt.

During the reflow process, the sensor of the conduction element may lose its holding strength. For example, in a sensor made of solder, the solder may melt. However, the solder may be held in place via the surface tension of the solder. The restraining element may prevent the conduction element from mechanically opening during the reflow process. After reflowing, the panel is allowed to cool at which time the sensor may once again regain its holding strength.

At block 505, the reflowable thermal fuse 100 may be utilized in a non-fault condition state. Referring to FIG. 1, during this mode of operation, current flowing from a source 120 through the reflowable thermal fuse 100 to a load 125 may flow through the serial circuit formed between the PTC device 105 and the conduction element 110 and also flow in parallel via the restraining element 115. The amount of current flowing through the restraining element 115 may be less than the amount of current necessary to mechanically open the restraining element 115.

At block 510, a fault condition may occur. For example, the ambient temperature in the vicinity of the reflowable thermal fuse 100 may increase to a dangerous level, such as 200° C.

At block 515, the resistance of the PTC device 105 may begin to increase with increases in the ambient temperature, as described in FIG. 2. As the resistance of the PTC device 105 increases, current flowing into the PTC device 105 may be diverted to the restraining element 115.

At block 520, the current flowing through the restraining element 115 reaches a point that causes the restraining element 115 to mechanically open, thus releasing the conduction element 110.

At block 525, the conduction element 110 may mechanically open. The conduction element 110 may open immediately after the restraining element 115 releases the conduction element 110. For example, the sensor of the conduction element 110 may have already lost its holding strength. Alternatively, the ambient temperature around the reflowable thermal fuse 100 may continue to increase and the sensor may give way at an elevated temperature. In yet another alternative, the current flowing into the reflowable thermal fuse 100 and through the PTC device 105 may cause the PTC device 105 to self heat to temperature sufficient enough to cause the sensor of the conduction element 110 to lose its holding strength.

As can be seen from the description above, the reflowable thermal fuse overcomes the problems associated with placement of thermal fuses on panels via reflow ovens. The restraining element enables securing the conduction element during the reflow process. Then during a fault condition, the PTC device effectively directs the current flowing through the reflowable thermal fuse to the restraining element, which in turn causes the restraining element to open. This in turn releases the conduction element.

While the reflowable thermal fuse and the method for using the reflowable thermal fuse have been described with reference to certain embodiments, it will be understood by those skilled in the art that various changes may be made and equivalents may be substituted without departing from the scope of the claims of the application. In addition, many modifications may be made to adapt a particular situation or material to the teachings without departing from its scope. Therefore, it is intended that reflowable thermal fuse and method for using the reflowable thermal fuse are not to be limited to the particular embodiments disclosed, but to any embodiments that fall within the scope of the claims.

We claim:

1. A thermal fuse comprising:

a positive-temperature-coefficient (PTC) device that defines a first end and a second end;

a conduction element that defines a first end and a second end, the first end of the conduction element in electrical communication with the second end of the PTC device; and a restraining element that defines a first end and a second end, the first end of the restraining element in electrical communication with the first end of the PTC device and the second end of the restraining element in electrical communication with the second end of the conduction element, the restraining element being adapted to prevent the conduction element from coming out of electrical communication with the PTC device in an installation state of the thermal fuse, wherein during a high temperature fault condition, heat applied to the thermal fuse causes current flowing between the first end of the PTC device and the second end of the conduction element to be diverted to the restraining element, causing the restraining element to release the conduction element.

2. The thermal fuse according to claim 1, wherein after the restraining element releases the conduction element, the applied heat causes the conduction element to electrically open.

3. A thermal fuse comprising:

a positive-temperature-coefficient (PTC) device that defines a first end and a second end;

a conduction element that defines a first end and a second end, the first end of the conduction element in electrical communication with the second end of the PTC device; and a restraining element that defines a first end and a second end, the first end of the restraining element in electrical communication with the first end of the PTC device and the second end of the restraining element in electrical communication with the second end of the conduction element, the restraining element being adapted to prevent the conduction element from coming out of electrical communication with the PTC device in an installation state of the thermal fuse, wherein during a high current fault condition, a fault current flowing into the thermal fuse causes current flowing between the first end of the PTC device and the second end of the conduction element to be diverted to the restraining element, causing the restraining element to release the conduction element, and the fault current causes the PTC device to generate heat that causes the conduction element to electrically open.

4. A thermal fuse comprising:

a positive-temperature-coefficient (PTC) device that defines a first end and a second end;

a conduction element that defines a first end and a second end, the first end of the conduction element in electrical communication with the second end of the PTC device, the conduction element including a sensor that releasably secures the conduction element into electrical communication with the second end of the PTC device; and a restraining element that defines a first end and a second end, the first end of the restraining element in electrical communication with the first end of the PTC device and the second end of the restraining element in electrical communication with the second end of the conduction element, the restraining element being adapted to prevent the conduction element from coming out of electrical communication with the PTC device in an installation state of the thermal fuse.

5. The thermal fuse according to claim 4, wherein the sensor melts at about 200° C.

6. The thermal fuse according to claim 5, wherein the conduction element includes a spring portion that is under tension.

7. A thermal fuse comprising:

a positive-temperature-coefficient (PTC) device that defines a first end and a second end;

a conduction element that defines a first end and a second end, the first end of the conduction element in electrical communication with the second end of the PTC device;

a restraining element that defines a first end and a second end, the first end of the restraining element in electrical communication with the first end of the PTC device and the second end of the restraining element in electrical communication with the second end of the conduction element, the restraining element being adapted to prevent the conduction element from coming out of electrical communication with the PTC device in an installation state of the thermal fuse; and a plurality of mounting pads disposed at least partially outside of the housing that enable surface mounting the thermal fuse to a panel.

8. The thermal fuse according to claim 7, wherein the first end of the PTC device and the first end of the restraining element are in electrical communication with a first pad of the plurality of pads and the second end of the conduction element and the second end of the restraining element are in electrical communication with a second pad of the plurality of mounting pads.

* * * * *